US007270741B2

(12) United States Patent
Roelofse et al.

(10) Patent No.: US 7,270,741 B2
(45) Date of Patent: Sep. 18, 2007

(54) METHOD OF PURIFYING A WATER-RICH STREAM PRODUCED DURING A FISCHER-TROPSCH REACTION

(75) Inventors: Andries Johannes Roelofse, Sasolburg (ZA); Richard Alan Russell, Burlington, MA (US)

(73) Assignee: Sasol Technology (Pty) Ltd, Sasolburg (ZA)

( * ) Notice: Subject to any disclaimer, the term of this patent is extended or adjusted under 35 U.S.C. 154(b) by 643 days.

(21) Appl. No.: 10/859,906

(22) Filed: Jun. 3, 2004

(65) Prior Publication Data

US 2004/0262199 A1 Dec. 30, 2004

Related U.S. Application Data

(63) Continuation of application No. PCT/ZA02/00190, filed on Nov. 29, 2002.

(60) Provisional application No. 60/339,814, filed on Dec. 6, 2001.

(30) Foreign Application Priority Data

Dec. 6, 2001 (ZA) ..... 2001/10041

(51) Int. Cl.
*C07C 27/26* (2006.01)

(52) U.S. Cl. ..... 208/187; 208/263; 208/950; 518/726

(58) Field of Classification Search ..... None
See application file for complete search history.

(56) References Cited

U.S. PATENT DOCUMENTS 2,482,284 A 9/1949 Michael et al.
2,683,158 A 7/1954 Brown et al.
6,462,097 B1 10/2002 Martino et al.

FOREIGN PATENT DOCUMENTS

FR 2807027 A1 10/2001

OTHER PUBLICATIONS

Official Communication for related Russian Patent Application 2004117601/04, mailed on Nov. 24, 2005.
International Search Report for PCT/ZA02/00190 dated Apr. 4, 2003.
International Preliminary Examination Report for PCT/ZA02/00190 dated Oct. 10, 2003.
PCT Written Opinion for PCT/ZA02/00190 dated Jun. 3, 2003.

*Primary Examiner*—Tam M. Nguyen
(74) *Attorney, Agent, or Firm*—Knobbe Martens Olson & Bear LLP

(57) ABSTRACT

This invention relates to an improved method of separating non-acid chemicals from a water rich stream produced during a Fischer-Tropsch (FT) reaction.

26 Claims, 1 Drawing Sheet

METHOD OF PURIFYING A WATER-RICH STREAM PRODUCED DURING A FISCHER-TROPSCH REACTION

RELATED APPLICATIONS

This application is a continuation, under 35 U.S.C. § 120, of International Patent Application No. PCT/ZA02/00190, filed on Nov. 29, 2002 under the Patent Cooperation Treaty (PCT), which was published by the International Bureau in English on Jun. 12, 2003, which designates the United States, and which claims the benefit of U.S. Provisional patent application No. 60/339,814, filed Dec. 6, 2001.

FIELD OF THE INVENTION

This invention relates to an improved method of separating non-acid chemicals from a water-rich stream produced during a Fischer-Tropsch (FT) reaction.

BACKGROUND TO THE INVENTION

In the specification that follows the term "NAC" is to be interpreted as meaning non-acid chemicals selected from the group including: acetone and higher ketones, methanol, ethanol, propanol and higher alcohols, i.e. oxygenated hydrocarbons excluding acids.

The term "hydrocarbons" is to be interpreted as hydrocarbons normally not soluble in water, such as, for example, paraffins and olefins.

The water-rich stream produced in a Fischer-Tropsch (FT) Synthesis unit contains various oxygenates such as alcohols, aldehydes, ketones, carboxylic acids, and the like, that are products of the FT synthesis reaction. These compounds are found (in part) in the water stream due to their partial or full solubility in water.

A distillation column is required to remove the non-acid chemicals (NAC's) such as alcohols, ketones, aldehydes, and other non-acid compounds from the water-rich stream, so that the upgraded water can be treated further before it is released into the environment. The NAC-rich stream from the distillation column can be worked up further into products or may find alternative applications.

The fractionation between NAC's and water in the distillation column, which is commonly referred to as the Reaction Water Distillation (RWD) Column, is complicated by the extreme non-ideal behaviour between water and heavier organics present in the water stream, notably the $C_4$ and heavier alcohols. This non-ideality makes these compounds easy to strip from the water-rich liquid phase below the feed tray, which is the purpose of the column. However, above the feed tray, as the water content of the liquid in the column decreases, the heavier alcohols become less volatile and tend to condense again.

The result is a tendency of the heavy alcohols to accumulate in the column, eventually to the point where a second liquid phase forms. This oxygenated hydrocarbon phase contains much more of the heavy alcohols and much less water than does the first phase. If the second liquid phase is left in the column, it provides a low-volatility path for heavy alcohols to migrate downward, until revaporized by rising vapour in the column. This results in circulation of oxygenated hydrocarbons such as, for example, heavy alcohols within the column, poor liquid distribution on the trays and eventual breakthrough of heavy material in the bottoms.

Such a breakthrough will cause the bottom product to violate specifications on the bottom product and could cause problems in the downstream water treatment facility due to contamination.

Therefore, the oxygenated hydrocarbon phase formed inside the column is normally removed via a relatively small vapour stream in the bottom section, typically a few trays above the reboiler, of the column. This vapour stream is then condensed and separated into two phases. The water-rich stream is sent back to the column by either mixing it with the feed to the column or by feeding it to the column on its own. The oxygenated hydrocarbon phase is typically mixed with the overhead stream for further processing.

This vapour draw-off is however not sufficient to remove the oxygenated hydrocarbon phase to such an extent that it would not appear in the column any more. The vapour draw is only able to remove enough of the oxygenated hydrocarbon phase to inhibit breakthrough to the bottom product. A large circulation of the organic phase therefore still takes place within the column, making it a relatively inefficient way of separating the chemicals from the water.

SUMMARY OF THE INVENTION

According to the invention there is provided a method for separating at least a fraction of non-acid chemicals (NAC's) from at least a fraction of a gaseous raw product produced during a Fischer-Tropsch (FT) reaction or a condensate thereof including at least the steps of:

- feeding at least the fraction of the gaseous raw product or the condensate thereof to a distillation column at a feed tray;
- withdrawing a liquid stream from the column from a tray located above the feed tray;
- separating the liquid stream into an aqueous phase and an NAC-rich phase; and
- returning the aqueous phase to the distillation column at a tray below the tray from which the liquid stream was withdrawn.

The method may include removing hydrocarbons in the $C_5$ to $C_{20}$ range from the condensate of the gaseous raw product in a preliminary step.

The preliminary step may Include condensing the gaseous raw product and then separating it in a three-phase separator. The three streams exiting the separator may be: a tail gas, a hydrocarbon condensate including mainly hydrocarbons in the $C_5$ to $C_{20}$ range and a so-called reaction water stream containing NAC's, water, acids and suspended hydrocarbons.

The reaction water stream may, for example, have the following composition (by mass): 96% water, 3% NAC, about 1% acids and from about 0.05 to 1.0% suspended hydrocarbons in the $C_5$ to $C_{20}$ range.

The suspended hydrocarbons may subsequently be separated from the reaction water stream using any suitable separator capable of separating the stream into a hydrocarbon suspension and a water-rich stream.

The separator used may be an oil coalescer, typically a Pall coalescer, capable of removing hydrocarbons from the reaction water stream to a concentration of between 10 ppm and 1000 ppm, typically 50 ppm.

The coalescer serves to increase the droplet size of the suspended hydrocarbons so as to allow easy liquid-liquid separation to take place.

Should the hydrocarbons contained in the reaction water stream (typically from 0.05 to 1% by mass) not be removed prior to distillation, they may cause foaming in the distillation column or may contaminate the bottom product thereby causing said product to not meet the required specifications on hydrocarbon content.

In an alternative embodiment, the separator or coalescer may be omitted before the distillation column and instead used to separate hydrocarbons from the bottom product of the distillation column after distillation.

The separated hydrocarbons may be recycled to the 3-phase separating step or sent to hydrocarbon processing units located downstream.

The water-rich stream produced by the removal of the suspended hydrocarbons is fed to the distillation column. The water-rich stream may contain some entrained free oil remaining after coalescence and from 1 to 10% by mass NAC's.

The distillation column used in the method may have from 30 to 60, typically between 38 and 44 trays.

The feed tray to the distillation column may be located between tray 7 and 15 and is typically tray 10 (when numbering the trays from the top of the column downwards).

The liquid stream may be withdrawn from the column from a tray located directly below a tray at which the NAC-rich phase first appears or forms and which tray is located above the feed tray, thereby inhibiting said phase from moving to a lower region of the column and subsequently recirculating to the top of the column. The liquid stream may subsequently be separated into an aqueous phase and the NAC-rich phase.

The liquid stream may be withdrawn from the distillation column at a tray located between tray 4 and tray 13, typically tray 6 (numbered from the top of the column). The liquid stream may be separated into the aqueous phase and the NAC-rich phase by means of a decanter located inside or outside the column.

The aqueous phase is returned to the column at a tray located below the tray from which the liquid stream was withdrawn, typically to the tray located immediately below the tray from which the liquid stream was withdrawn.

The separated NAC-rich phase may be mixed with the overhead products of the distillation column for further processing or may be processed on its own to recover valuable components, or it may be fed to a Hydroprocessing unit that is typically located at the same site as the distillation column.

The NAC-rich phase obtained from the separation of the liquid stream drawn off from the column may contain from 90 to 100%, typically 95%, by mass NAC's (including mainly heavy alcohols), whilst the aqueous phase may contain from 80 to 100%, typically about 94%, by mass water.

A NAC-lean, water-rich stream may be recovered as a bottom product of the column.

The bottom product may include mainly water and organic acids from the water-rich stream along with a minimal amount of NAC's, typically about 50 ppm. The bottom product may be used to heat the water-rich stream entering the distillation column before being treated further or released into the environment.

A NAC-rich stream containing water may be recovered as an overhead product of the column.

Operating conditions of the column may be such that the overhead product contains from 15 to 45%, typically from 25 to 30% by mass water.

BRIEF DESCRIPTION OF THE DRAWINGS

The invention will now be described by way of the following non-limiting example with reference to the accompanying drawing.

DETAILED DESCRIPTION OF THE PREFERRED EMBODIMENT

Figure 1:
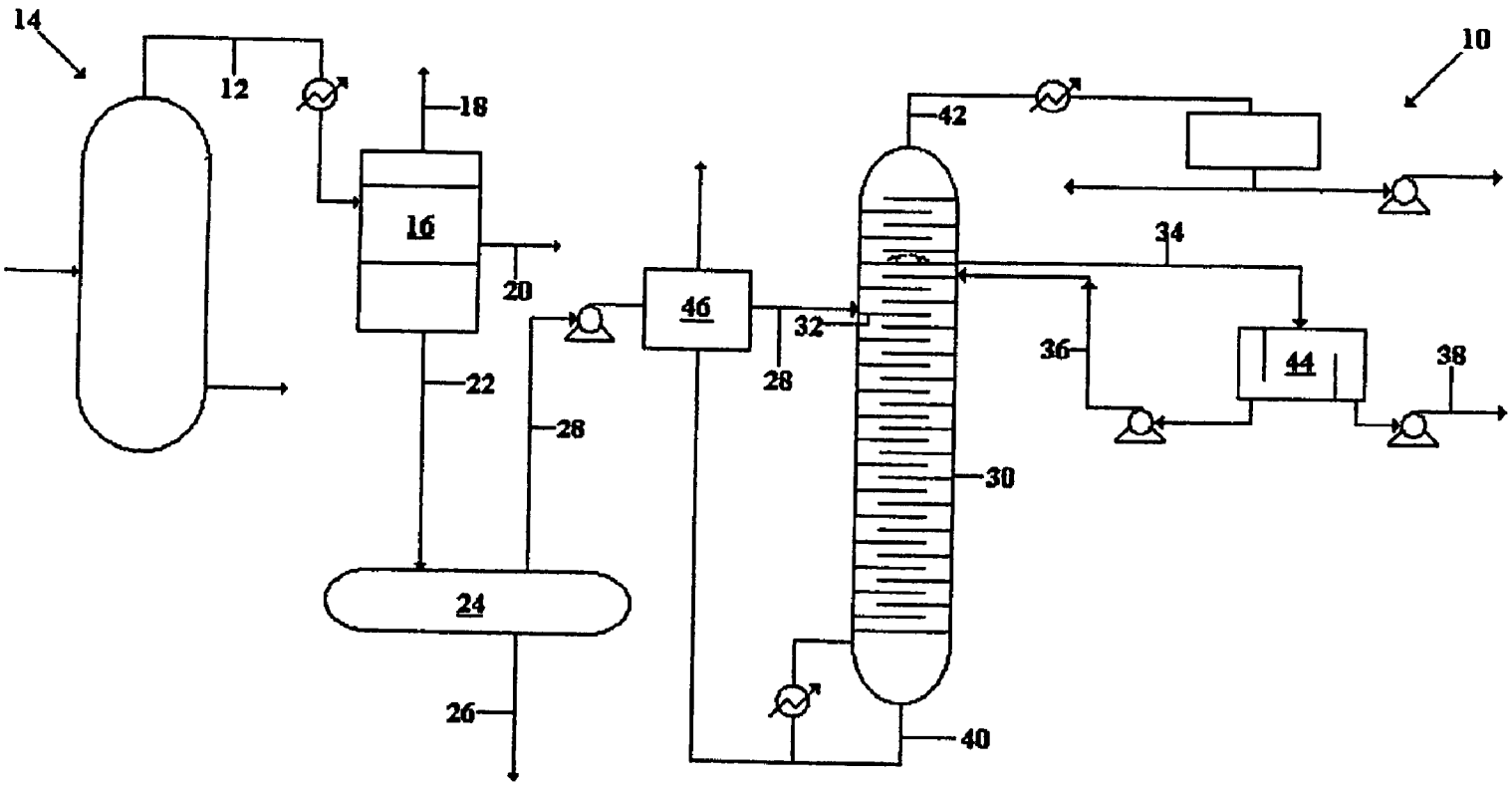
FIG. 1 shows a flow diagram of an embodiment of a method in accordance with the present invention.

In the drawing, reference numeral 10 generally indicates a method of separating at least a fraction of non-acid chemicals (NAC's) from a condensed water rich fraction 28 of gaseous raw product 12 produced during a Fischer-Tropsch (FT) reaction 14.

The process 10 includes a preliminary step wherein suspended hydrocarbons are removed from a fraction of the gaseous raw product 12.

The preliminary step includes condensing the gaseous raw product 12 and separating it in a typical three-phase separator 16. The three streams exiting the separator 16 are: a tail gas 18, a hydrocarbon condensate 20 including mainly hydrocarbons in the $C_5$ to $C_{20}$ range and a so-called reaction water stream 22 containing NAC's, water, acids and suspended hydrocarbons.

The reaction water stream 22 typically has the following composition (by mass): 96% water, 3% NAC, about 1% acids and from about 0.05 to 1.0% suspended hydrocarbons in the $C_5$ to $C_{20}$ range.

The reaction water stream 22 is then separated using a Pall coalescer 24 that separates the reaction water stream 22 into a hydrocarbon suspension 26 and the water-rich stream 28.

The Pall coalescer 24 is capable of removing hydrocarbons from the reaction water stream 22 to a concentration of from 10 ppm to 1000 ppm, typically 50 ppm.

The hydrocarbon suspension 26 is either recycled to the 3-phase separator 16 or sent to hydrocarbon processing units (not shown) located downstream.

Thereafter, the water-rich stream 28 is fed to a distillation column 30 at a feed tray 32.

A liquid stream 34 is withdrawn from the column 30 from a tray located above the feed tray 32. The liquid stream 34 includes two liquid phases formed in the distillation column 30, namely an NAC-rich phase and a water-rich or aqueous phase. The withdrawal of the liquid stream 34 removes substantially all the liquid from the column 30, thereby ensuring that as much as possible of the NAC-rich phase is removed from the column 30 at this point.

The liquid stream 34 is then separated into an aqueous phase 36 and an NAC-rich phase 38, whereafter the aqueous phase 36 is returned to the distillation column 30 at a tray below the tray from which the liquid stream 34 was withdrawn.

A NAC-lean, water-rich stream 40 is recovered as a bottom product of the column 30.

A NAC-rich stream 42 containing water is recovered as an overhead product of the column 30.

The distillation column 30 shown in FIG. 1 has 42 trays. The feed tray 32 is tray number 10 (when numbering the trays from the top of the column 30 downwards) and the liquid stream 34 is withdrawn at tray number 6 (numbered from the top of the column 30).

In the embodiment shown, the liquid stream 34 is separated by means of a decanter 44 located outside the column 30.

Operating conditions of the column 30 are typically such that the overhead product 42 contains from 15 to 45%, typically from 25 to 30% by mass water.

The bottom product 40 contains mainly water and organic acids from the raw product 12 along with a minimal amount of NAC's, typically about 50 ppm.

The NAC-rich stream 38 typically contains 95% by mass NAC's (including mainly heavy alcohols), whilst the aqueous phase 36 typically contains about 94%, by mass water.

The bottom product 40 is used to heat the water-rich stream 28 entering the distillation column 30 via heat exchanger 46 before being treated further or being released into the environment.

It is to be appreciated, that the invention is not limited to any specific embodiment or configuration as hereinbefore generally described or illustrated.

What is claimed is:

1. A method for separating at least a fraction of non-acid chemicals from at least a fraction of a gaseous raw product produced during a Fischer-Tropsch reaction or a condensate of a gaseous raw product produced during a Fischer-Tropsch reaction, the method comprising the steps of:

feeding at least the fraction of the gaseous raw product or the condensate of the gaseous raw product to a distillation column at a feed tray;

withdrawing a liquid stream from the distillation column from a tray located above the feed tray;

separating the liquid stream into an aqueous phase and a non-acid chemicals-rich phase; and returning the aqueous phase to the distillation column at a tray between the tray which the liquid stream was withdrawn.

2. A method as claimed in claim 1, further comprising a step of removing hydrocarbons in a $C_5$ to $C_{20}$ range from the condensate of the gaseous raw product, wherein the step is conducted before the step of feeding.

3. A method as claimed in claim 2, further comprising a step of condensing the gaseous raw product, wherein the step is conducted before the step of separating.

4. A method as claimed in claim 3, further comprising a step of recovering a tail gas, a hydrocarbon condensate comprising mainly hydrocarbons in a $C_5$ to $C_{20}$ range, and a reaction water stream comprising non-acid chemicals, water, acids, and suspended hydrocarbons.

5. A method as claimed in claim 4, further comprising a step of separating the suspended hydrocarbons from the reaction water stream using a separator capable of separating the reaction water stream into a hydrocarbon suspension and a water-rich stream.

6. A method as claimed in claim 5, wherein the separator is an oil coalescer.

7. A method as claimed in claim 6, wherein the coalescer is capable of removing hydrocarbons from the reaction water stream, such that the concentration of hydrocarbons in the reaction water stream is reduced to a concentration of from 10 ppm to 1000 ppm.

8. A method as claimed in claim 1, wherein at least one of a two phase separator and a coalescer are used to separate hydrocarbons from a bottom product of the distillation column.

9. A method as claimed in claim 5, wherein the separated hydrocarbons are recycled to a three-phase separating step.

10. A method as claimed in claim 5, wherein the separated hydrocarbons are sent to a hydrocarbon processing unit located downstream of the distillation column.

11. A method as claimed in claim 5, wherein the water-rich stream is fed to the distillation column.

12. A method as claimed in claim 1, wherein the distillation column has from 30 to 60 trays.

13. A method as claimed in claim 1, wherein the distillation column has from 38 to 44 trays.

14. A method as claimed in claim 1, wherein the feed tray to the distillation column is located between tray 7 and tray 15, wherein trays are numbered from a top of the distillation column downwards.

15. A method as claimed in claim 1, wherein the feed tray to the distillation column is tray 10, wherein trays are numbered from a top of the distillation column downwards.

16. A method as claimed in claim 1, wherein the withdrawing step comprises withdrawing the liquid stream from the distillation column from a tray located directly below a tray at which the non-acid chemicals-rich phase first appears or forms.

17. A method as claimed in claim 16, wherein the separation step comprises separating the liquid stream into the aqueous phase and the non-acid chemicals-rich phase by a decanter located inside the distillation column or outside the distillation column.

18. A method as claimed in claim 1, wherein the liquid stream is withdrawn from the distillation column at a tray located between tray 4 and tray 13, wherein trays are numbered from a top of the distillation column downwards.

19. A method as claimed in claim 1, wherein the liquid stream is withdrawn from the distillation column at tray 6, wherein trays are numbered from a top of the distillation column downwards.

20. A method as claimed in claim 1, wherein the step of returning comprises returning the aqueous phase to a tray located immediately below the tray from which the liquid stream was withdrawn.

21. A method as claimed in claim 1, wherein the non-acid chemicals-rich phase is mixed with overhead products of the distillation column for further processing.

22. A method as claimed in claim 1, wherein the separated non-acid chemicals-rich phase is fed to a hydroprocessing unit that is located at a same site as the distillation column.

23. A method as claimed in claim 1, wherein a non-acid chemicals-lean, water-rich stream is recovered as a bottom product of the distillation column.

24. A method as claimed in claim 1, wherein a non-acid chemicals-rich stream comprising water is recovered as an overhead product of the distillation column.

25. A method as claimed in claim 1, wherein operating conditions of the distillation column are such that the overhead product comprises from 15 to 45% by mass water.

26. A method as claimed in claim 1, wherein operating conditions of the column are such that the overhead product comprises from 25 to 30% by mass water.

* * * * *